United States Patent [19]

Boschung

[11] Patent Number: 4,858,270

[45] Date of Patent: Aug. 22, 1989

[54] PAVEMENT-CLEANING VEHICLE

[75] Inventor: Marcel Boschung, Schmitten, Switzerland

[73] Assignee: Reberle reg. Treuunternehmen Schaan, Schaan, Liechtenstein

[21] Appl. No.: 181,450

[22] Filed: Apr. 14, 1989

[30] Foreign Application Priority Data

Apr. 23, 1987 [CH] Switzerland ..... 1557/87

[51] Int. Cl.[4] ..... E01H 1/08

[52] U.S. Cl. ..... 15/328; 15/340.3; 15/346; 15/354; 37/196

[58] Field of Search ..... 15/78, 82, 340.1, 340.3, 15/345, 346, 347, 328, 354; 37/197, 232, 196

[56] References Cited

U.S. PATENT DOCUMENTS

| | | | |
|---|---|---|---|
| 293,209 | 2/1884 | Herron | 15/346 |
| 514,676 | 2/1894 | Furnas | 15/346 X |
| 983,988 | 2/1911 | Foster et al. | 15/421 X |
| 1,033,164 | 7/1912 | Fahrney | 15/346 |
| 1,048,009 | 12/1912 | Vogelzangs et al. | 15/346 |
| 1,560,612 | 11/1925 | Sims | 37/232 |
| 1,923,689 | 8/1933 | Rosenberg | 15/346 X |
| 3,007,191 | 11/1961 | Braun | 15/346 |
| 3,048,876 | 8/1962 | Kemnitz | 15/421 X |
| 3,512,206 | 5/1970 | Young | 15/346 |
| 3,605,170 | 9/1971 | Hank et al. | 15/346 |
| 4,193,159 | 3/1980 | Beard | 15/346 X |
| 4,457,043 | 7/1984 | Oeberg et al. | 15/346 |
| 4,466,156 | 8/1984 | Blehart | 15/346 |
| 4,685,228 | 8/1987 | Gisler | 37/197 |

*Primary Examiner*—Chris K. Moore

*Attorney, Agent, or Firm*—Dann, Dorfman, Herrell & Skillman

[57] ABSTRACT

A chassis frame is supported on a front steering axle and a rear steering axle. Between the two axles and beneath the chassis frame, a hollow support serving as a main blow duct is pivotingly disposed. Raisably and lowerably connected to the support via levers is a sweeping-brush roller. Connected to the support are blowing nozzles which lead air supplied by a fan mounted on the chassis frame into a blow duct formed by a cover plate disposed in front of the sweeping-brush roller. Disposed within the blow duct are two suction ports which are connected via dirt-suction pipes to a vacuum-sweepings container disposed on the chassis frame. The outlet of the vacuum-sweeings container is connected at a dismantling point to an air-suction duct which is in turn connected to the intake of the fan. This cleaning vehicle can be used for snow clearance by opening a flap and closing another flap in an air-outlet pipe piece and by moving an operating lever from a middle position into either of two end positions.

6 Claims, 2 Drawing Sheets

PAVEMENT-CLEANING VEHICLE

Figure 3:
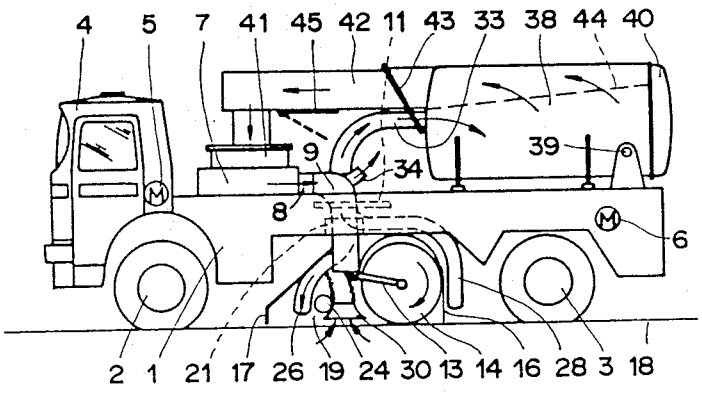

The invention relates to a vehicle for cleaning ground surfaces provided with a rigid pavement, of the type having a chassis frame on which a traction engine, a working engine, and a fan drivable by the working engine are mounted, having a sweeping-brush roller pivotable about a substantially vertical axis and drivable by the aforementioned working engine or by another working engine, a main blow-air duct connectible to the blowing side of the fan, pivotable blowing nozzles connected thereto, and a cover disposed in front of the sweeping-brush roller in the direction of operational travel to form a blow duct running substantially parallel to the longitudinal axis of the sweeping-brush roller.

U.S. Pat. No. 4,685,228 describes a snow-removing machine having a chassis frame, supported by a front steering axle and a rear axle, and a traction engine for locomotion. Disposed between the axles is a sweeping-brush roller extending at right angles to the longitudinal axis of the machine. A hollow support, serving at the same time as a blown-air duct, is pivoted on the underside of the chassis, and the sweeping brush is raisably and lowerably hinged to the mentioned support by means of levers. The output side of a fan is connected to the air duct which distributes the blown air to various blowing nozzles disposed in front of the sweeping brush, relative to the direction of operational travel. The fan and the sweeping brush are driven by a working engine. Disposed at the front of this prior art snow-removing machine is a snow plow which pushes the major part of the snow lying on the ground either to the left or to the right, depending upon its angle to the longitudinal axis of the machine. Remnants of snow left lying on the ground are blown aside in the same direction by the blowing nozzles under the chassis. Any snow still adhering to the ground is swept by the sweeping brush into the vicinity of the nozzles and likewise blown away. This prior art snow-removing machine is very well suited to clearing snow off airport runways and taxiways but not to keeping these surfaces clean at other times of year.

A further device for cleaning surfaces by means of a flow of air is described, for example, in U.S. Pat. No. 3,512,206. This device has a take-up head movable over the surface to be cleaned, a blower for producing the flow of air at the take-up head, and a collector for the dust taken up. The take-up head is box-shaped, and there are elastic curtain elements along the edge to form a substantially closed space beneath the take-up head. This head has a compressed-air duct opening out into the closed space through a slot and, leading out of the space, a suction duct through which the dust stirred up by the compressed air is drawn into the collector. Dust and dirt can be taken up only from snow-free ground with this device, and it cannot be used for snow clearance.

Hence the main drawback of the expensive apparatus described above is that it can be used only in winter and in summer, respectively.

It is an object of this invention to provide an improved surface-cleaning vehicle which is equally suitable for use as a large-area snow-clearance machine with a snow plow and blower-sweeper, and as a large-area vacuum sweeper, so that the same cleaning vehicle can be used all year round and is thus more economical.

To this end, in the vehicle for cleaning ground surfaces according to the present invention, of the type initially mentioned, at least one suction port connectible to the suction side of the fan is raisably and lowerably disposed within the blow duct, there are at least two blowing nozzles which are directed toward the suction port, and there is a deflector device for leading the airflow produced by the fan either to the blowing nozzle directed from right to left in the longitudinal direction of the blow duct, to the blowing nozzle directed from left to right in the longitudinal direction of the blow duct, or to all blowing nozzles.

Figure 4:
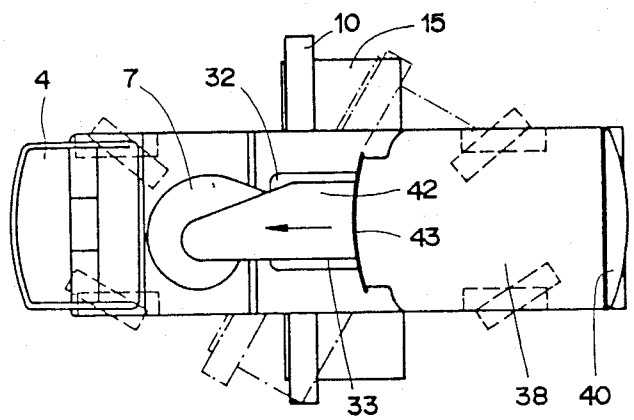
Figure 1:
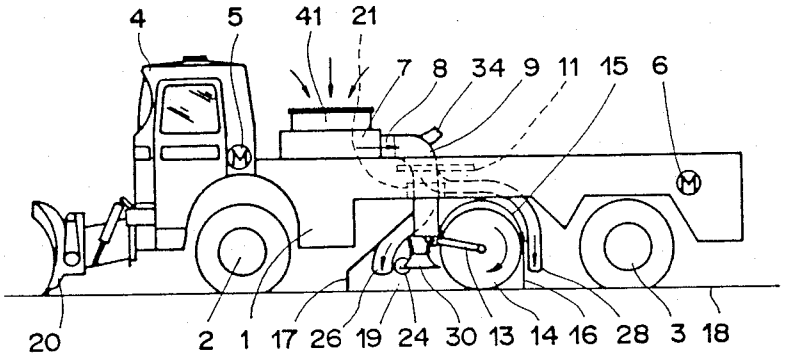
Figure 2:
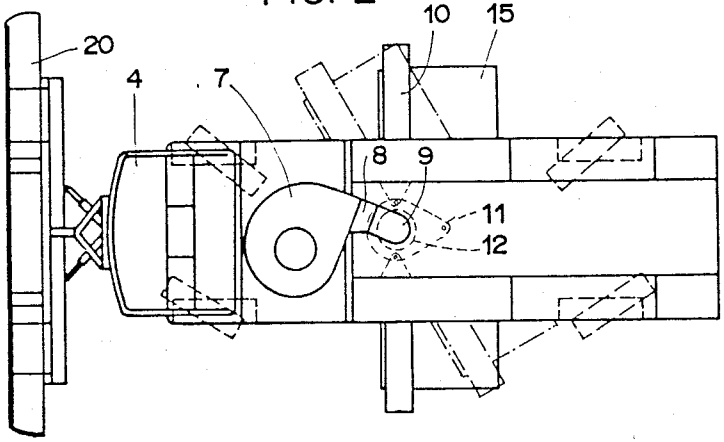
Figure 5:
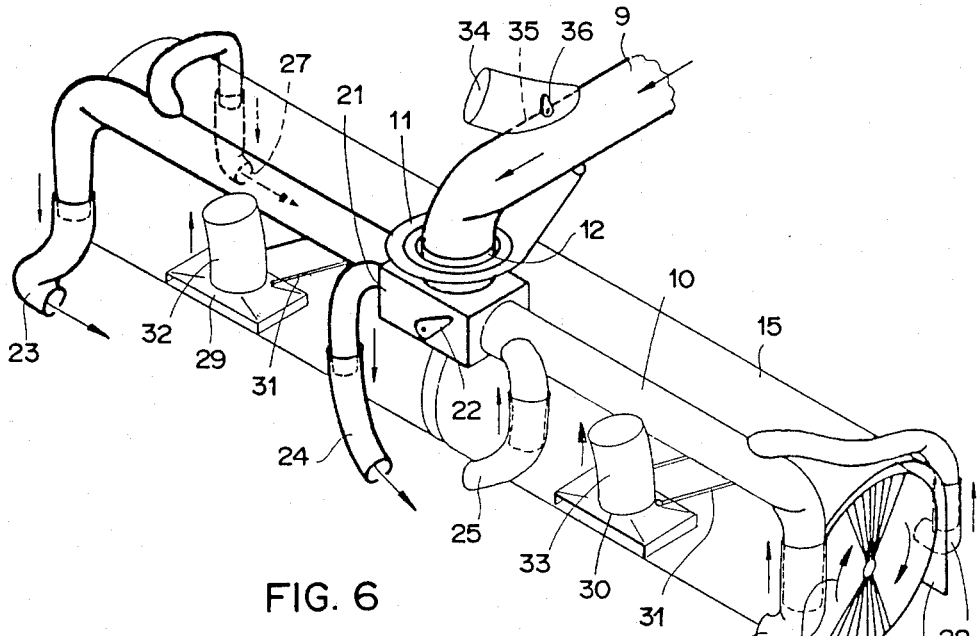
Figure 6:
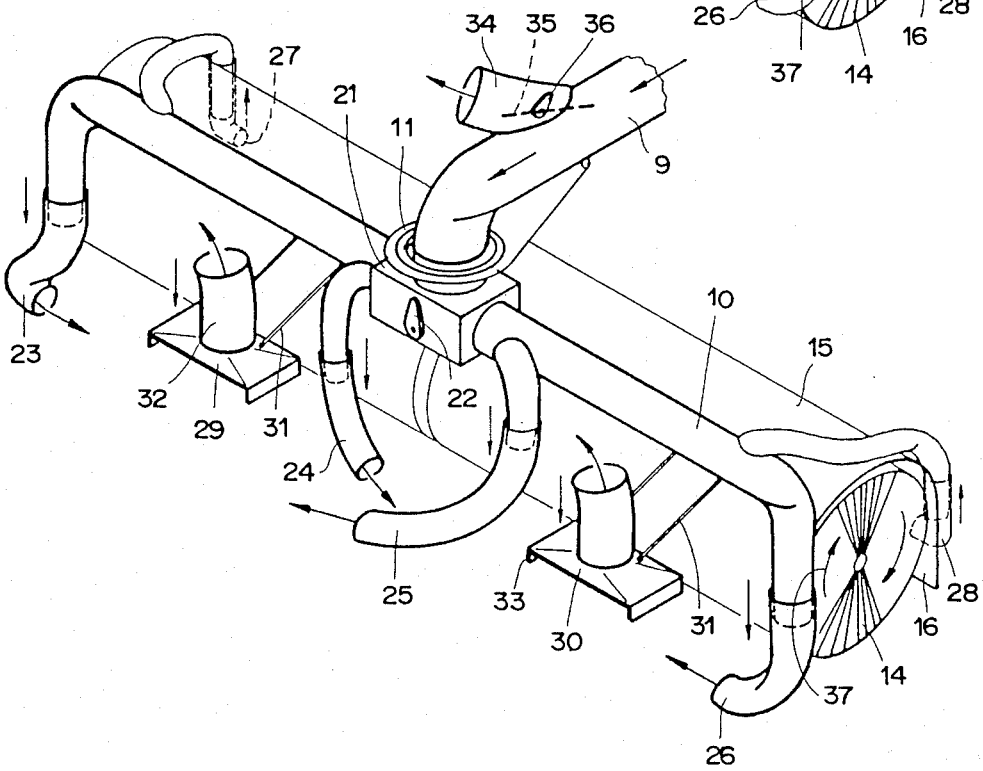

Preferred embodiments of the invention will now be described in detail with reference to the accompanying drawings, in which:

FIG. 1 is a side elevation of an embodiment of the cleaning vehicle according to the invention equipped as a snow-clearance vehicle with a snow plow and a blower-sweeper apparatus, FIG. 2 is a top-plan view of the cleaning vehicle depicted in FIG. 1, FIG. 3 is a side elevation of an embodiment of the cleaning vehicle equipped as a vacuum sweeper with the blower-sweeper apparatus and a suction container for sweepings, FIG. 4 is a top plan view of the cleaning vehicle depicted in FIG. 3, FIG. 5 is a simplified perspective view of the blower-sweeper apparatus of the cleaning vehicle adjusted for snow clearance, and FIG. 6 is a simplified perspective view of the blower-sweeper prepared for vacuum sweeping.

The cleaning vehicle illustrated in FIGS. 1–4 has a chassis frame 1 supported by means not shown on a steerable front planetary axle 2 and a selectively steerable rear planetary axle 3. In the front region of chassis frame 1 is a cab 4. Behind and beneath cab 4 is a traction engine 5 which drives front planetary axle 2 and, selectively, rear planetary axle 3 as well. By means of a steering-mode switching device (not shown) in cab 4, it is possible to shift from within cab 4 to front-wheel, all-wheel, or crab steering. With all-wheel steering, the rear axle exactly follows the alignment of the front axle and thus compels the blower-sweeper apparatus, to be described in more detail below, to keep in the track of the vehicle even during cornering. When the driver shifts to crab steering, all four wheels are steered in the same direction, which leads to diagonal displacement of the entire vehicle. Obstacles can thus be avoided, and maneuvering is facilitated.

By being bent at angles, chassis frame 1 is so designed in the area between front planetary axle 2 and rear planetary axle 3 that as high a clearance as possible is created between the chassis and the roadway to make room for the aforementioned blower-sweeper apparatus.

In the region above rear planetary axle 3 there is a working engine 6. This engine drives two, or if need be more, hydraulic swivel piston pumps (not shown), which in turn drive via two axial-piston motors a high-output radial-flow blower 7 and a sweeping-brush drive (not shown).

The outlet 8 of radial-flow blower 7 communicates via a pipeline 9 with a hollow support 10 which simultaneously serves as a main blown-air duct. The support 10 is connected to chassis frame 1 and pivoted about a vertical axis by means of a three-point suspension 11 secured to chassis frame 1 and a ring mount 12 secured to support 10. FIGS. 2 and 4 each show in dot-dash lines one of the two end pivot positions of support 10. Connected to support 10 via levers 13 is a sweeping-brush roller 14 which can be raised from or lowered onto the ground by means of hydraulic drive cylinders (not shown). The sweeping-brush roller 14 is made in two parts and can be rotated by means of a chain drive (not shown) disposed in the middle of sweeping-brush roller 14. an embodiment of such a chain drive is described in more detail with reference to FIG. 9 of U.S. Pat. No. 4,685,228 mentioned earlier.

Above sweeping-brush roller 14 is a curved protective shield 15 extending over the entire length of sweeping-brush roller 14. Protective shield 15 covers the upper half of sweeping-brush roller 14 and keeps it from flinging snow, dust, or dirt upward. A protective rubber flap 16 hangs from the rearward end of protective shield 15. Disposed in front of sweeping-brush roller 14 is a cover plate 17 which, together with sweeping-brush roller 14 and the ground 18, forms a blow duct 19 extending over the entire length of sweeping-brush roller 14.

The cleaning vehicle shown in FIGS. 1 and 2 is outfitted for snow clearance. For this purpose, a snow plow 20 of a design known per se is mounted on the front of the cleaning vehicle. Snow plow 20 can be pivoted about a vertical axis so that the snow may be pushed to the left or to the right.

FIG. 5 shows in a simplified perspective view the blower-sweeper apparatus adjusted for winter operation, comprising support 10, which serves as a main blow duct and is connected, pivotingly about a vertical axis, by means of ring mount 12 and three-point suspension 11 to chassis frame 1 (not shown in FIG. 5), and sweeping-brush roller 14, which is raisable and lowerable by means of levers 13 (not shown in FIG. 5). In the middle of support 10 and beneath ring mount 12 there is an ajustable deflector device 21 having an air baffle (not visible) which can be swivelled about a horizontal axis and set to any one of three positions by means of an operating lever 22.

When operating lever 22 is in the position shown in FIG. 5, the non-visible air baffle is swivelled to the right, as viewed in FIG. 5, so that all the air entering deflector device 21 through pipeline 9 is led into the left-hand half of support 10. Connected tothe left-hand half, as viewed in FIG. 5, of the main blown-air duct formed by support 10 are two blowing nozzles 23 and 24 which open out through cover plate 17 (not shown in FIG. 5) into blow duct 19 and are directed toward the right. Connected to the right-hand half, as viewed in FIG. 5, of the main blown-air duct formed by support 10 are two blowing nozzles 25 and 26 which extend through the non-visible cover plate 17 into blow duct 19 and are directed toward the left. At each end of the main blown-air duct formed by support 10 is one of two blowing nozzles 27 and 28, each closable and disposed behind protective rubber flap 16, relative to the operating direction. These two closable blowing nozzles 27, 28 are directed toward one another.

In front of each half of sweeping-brush roller 14, relative to the operating direction, one of two suction ports 29 and 30 is disposed under cover plate 17; see FIGS. 1 and 2. The suction ports 29, 30 are connected by a parallelogram linkage 31 to the underside of support 10 and can be raised into an upper position or lowered into operating position with the aid of hydraulic jacks (not shown). Connected to each of the suction ports 29, 30 are dirt-suction pipes 32 and 33, respectively.

Disposed on the upper side of pipeline 9 is an air-outlet pipe piece 34 closable by means of a flap 35 indicated by a dashed line. Flap 35 can be operated by means of an operating lever 36.

As already mentioned, the blower-sweeper apparatus shown in FIG. 5 is adjusted for winter operation, i.e., for snow clearance. Operating levers 22 and 36 are in the positions shown so that all the air delivered by radial-flow blower 7 goes into the left-hand half, as viewed in FIG. 5, of the main blown-air duct formed by support 10 and thus to blowing nozzles 23, 24, and 27. By means of the identically directed blowing nozzles 23, 24, an airflow is produced within blow duct 19 (see FIG. 1) in front of the sweeping-brush roller 14, which airflow conveys to the right, as viewed in FIG. 5, all the loose snow in blow duct 19. Any snow adhering to the ground 18 is swept by the following sweeping-brush roller 14, which is driven in the direction indicated by arrow 37, into blow duct 19 and caught by the aforementioned airflow. Finally, any remnant of loose snow remaining behind sweeping-brush roller 14 is blown away by blowing nozzle 27.

The suction ports 29, 30 not needed for snow clearance are in their uppermost position so that the airflow is hindered as little as possible.

If the snow is to be conveyed by the blower-sweeper apparatus to the left, as viewed in FIG. 5, operating lever 22 is moved to the other end position, the result being that the air delivered by radial-flow blower 7 goes into the right-hand half of the main blown-air duct formed by support 10 and thus to nozzles 25, 26, and 28.

FIG. 3 and 4 show the cleaning vehicle outfitted for vacuum-sweeping operation. For this purpose, a vacuum-sweepings container 38, tiltable about a horizontal axis 39 for emptying, is placed on the chassis frame 1. The back of vacuum-sweepings container 38 can be tightly closed by means of a closure cover 40. Dirt-suction pipes 32 and 33, as well as an air-suction duct 42 connectible to the intake 41 of radial-flow blower 7, are detachably connected to vacuum-sweepings container 38 by means of inclined flanges at a dismantling point 43. Within vacuum-sweepings container 38 is a filter sieve 44, indicated by a dashed line, which keeps the dirt drawn in from entering radial-flow blower 7. The blower-sweeper apparatus shown in FIG. 6 is adjusted for vacuum-sweeping operation. Operating lever 22 is in its middle position so that air goes into both halves of the main blown-air duct formed by support 10 and to blowing nozzles 23, 24, 25, and 26. The blowing nozzles 27, 28 disposed behind protective rubber flap 16 are closed by means not shown, e.g., suitable covers. Furthermore, flap 35 in air-outlet pipe piece 34 is partly open so that some of the air delivered by radial-flow blower 7 can exit. In this way, a slight underpressure is produced in blow duct 19, whereby dust is prevented from leaving blow duct 19. A water tank for a spray system (not shown), such as is usually necessary for keeping down the dust, may be integrated in or disposed outside vacuum-sweepings container 38.

The suction ports 29, 30 are lowered into operating position, and sweeping-brush roller 14 is driven at a reduced speed of rotation as compared with the snow-clearance operation. The radial-flow blower 7 draws in air through suction ports 29, 30, dirt-suction pipe 32 and 33, vacuum-sweepings container 38 with filter sieve 44, and air-suction duct 42, thereby causing underpressure to occur in vacuum-sweepings container 38, suction pipes 32 and 33, and suction ports 29, 30 when flap 45 is closed. Flap 45 is opened if vacuum-sweepings container 38 is not removed when the cleaning vehicle is prepared for winter operation.

By supplying small quantities of sprayed water from the aforementioned water tank, dust is entrapped in the suction ports 29, 30, and even outside them if necessary, so that the air drawn in through filter sieve 44 and blown out by radial-flow blower 7 is as free of dust as possible. The sweeping-brush roller 14 supports the work of the blowing nozzles 23 to 26 by loosening encrusted dirt and/or sweepings not removed by the blowing nozzles and flinging them into the vicinity of blowing nozzles 23 to 26 and/or conveying them directly to suction ports 29, 30 from behind.

In this way it is possible, by means of a slight changeover, to use the same cleaning vehicle with the same operating unit both as an efficient sweeper-blower vehicle for snow clearance and as an equally efficient vacuum-sweeping vehicle and thereby to provide a year-round operating machine with all its advantages. For the operating crew, handling thus becomes more familiar and use thereby surer. Permanent availability is better ensured, and the overall space required for accommodation is less.

What is claimed is:

1. A vehicle for cleaning ground surfaces provided with a rigid pavement, of the type having a chassis frame adapted for movement in a direction of travel along said pavement, and, mounted on the chassis frame, a traction engine, at least one working engine, and a fan having a suction-side intake and a blowing-side outlet and drivable by said working engine, the vehicle further having a sweeping-brush roller having a longitudinal axis transverse to said direction of travel and pivotable about a substantially vertical axis to vary the angle between said longitudinal axis and the direction of travel, drive means including said working engine for rotating the sweeping-brush roller about its longitudinal axis, a main blown-air duct connectible to the outlet of the fan, blowing nozzles connected to the main blown-air duct, and a cover disposed in front of the sweeping-brush roller in the direction of travel to form a blow duct running substantially parallel to the longitudinal axis of the sweeping-brush roller, wherein the improvement comprises:

at least one suction port disposed for vertical adjustment within said blow duct at a location between the opposite ends of said brush, the upper limit of said adjustment being suited for snow clearing, and the lower limit being suited for vacuum-sweeping, means for connecting said suction port to said intake of said fan, a blowing nozzle at each of the opposite ends of said brush having an airflow path directed toward said suction port, a deflector device for leading airflow produced by said fan to either one or to both of said blowing nozzles, and means to raise said suction port to one position out of the airflow path of said blowing nozzles, and to lower said suction port to a second position adjacent the rigid pavement within the airflow paths from said blowing nozzles.

2. The cleaning vehicle of claim 1, further comprising:

a pipeline disposed between said outlet of said fan and said main blown-air duct, an air-outlet pipe piece branching off said pipeline, and a flap mounted in said pipe piece for allowing part of the air delivered by said fan to exit when said cleaning vehicle is adjusted to lower the suction port for vacuum-sweeping operation, said suction-side intake being connected to the suction port whereby the entire intake of said fan is drawn from said blow cut below said cover, said intake airflow from said blow duct being greater than the flow through said blowing nozzles.

3. The cleaning vehicle of claim 1, further comprising:

a vacuum-sweepings container disposed tiltably and detachably on said chassis frame and including an exhaust port, an air-suction duct connected to said intake of said fan and adapted to connect said exhaust port of said vacuum-sweeping container to said intake, and a flap mounted in said air-suction duct for allowing air to be drawn in from outside when said cleaning vehicle is adjusted for snow clearance.

4. The cleaning vehicle of claim 1 comprising at least two working engines, further comprising selectively-operable speed-reduction means disposed between a said working engine and said sweeping-brush roller for reducing the speed of rotation of said sweeping-brush roller during vacuum-sweeping operation.

5. The cleaning vehicle of claim 1 comprising at least two working engines, wherein said drive means of said sweeping-brush roller are variable-speed drive means enabling said sweeping-brush roller to rotate at a reduced speed during vacuum-sweeping operation, the driving speed of the said working engine driving said fan being variable independently of that of said drive means of said sweeping-brush roller.

6. A cleaning vehicle according to claim 1 including selectively-operable flow control means to vary the quantity of the airflow into the blow duct through said nozzles relative to the airflow out of the blow duct through said suction port.

* * * * *